US007698759B1

(12) United States Patent
Frasier

(10) Patent No.: US 7,698,759 B1
(45) Date of Patent: Apr. 20, 2010

(54) BED SHEET SECURING ASSEMBLY

(76) Inventor: Roger A. Frasier, 422 S. Danbrook St., Anaheim, CA (US) 92804

( * ) Notice: Subject to any disclaimer, the term of this patent is extended or adjusted under 35 U.S.C. 154(b) by 0 days.

(21) Appl. No.: 12/174,725

(22) Filed: Jul. 17, 2008

(51) Int. Cl.
*A47C 21/02* (2006.01)

(52) U.S. Cl. ..... 5/504.1; 24/72.5

(58) Field of Classification Search ..... 5/504.1, 5/496, 498; 24/72.5, 265 EC, 499, 500, 507, 24/511; 70/14, 19, 58
See application file for complete search history.

(56) References Cited

U.S. PATENT DOCUMENTS

| | | | | |
|---|---|---|---|---|
| 852,180 | A * | 4/1907 | Hoffman | 24/72.5 |
| 1,252,885 | A * | 1/1918 | Cook | 24/535 |
| 1,336,746 | A * | 4/1920 | Ivory | 433/139 |
| 2,299,371 | A | 10/1942 | Allen | |
| D297,999 | S | 10/1988 | Kent | |
| 5,072,470 | A | 12/1991 | Lysiak | |
| 5,245,715 | A | 9/1993 | Dinkins | |
| 5,377,391 | A | 1/1995 | Foster | |
| 5,467,491 | A | 11/1995 | Griffith | |
| 6,295,670 | B1 | 10/2001 | Schieberl | |
| 7,152,260 | B2 | 12/2006 | Ota | |

* cited by examiner

*Primary Examiner*—Peter M. Cuomo
*Assistant Examiner*—Mark Williams

(57) ABSTRACT

A bed sheet securing assembly includes a clamp that is removably attachable to a bed sheet. The clamp includes a first plate and a second plate. Each of the first and second plates has a first side, a second side, a back edge and a front edge. A biasing member is attached to each of the back edges of the plates and biases the first side of the first plate against the second side of the second plate. A tether is attached to the clamp. The tether is removably couplable to a bed on which the sheet is positioned. An opening apparatus is removably engaged with the clamp and is actuated to open the clamp.

4 Claims, 5 Drawing Sheets

BED SHEET SECURING ASSEMBLY

BACKGROUND OF THE INVENTION

Field of the Invention

The present invention relates to bed sheet securing devices and more particularly pertains to a new bed sheet securing device for preventing a sheet or blanket from falling off of a bed.

SUMMARY OF THE INVENTION

The present invention meets the needs presented above by generally comprising a clamp that is removably attachable to a bed sheet. The clamp includes a first plate and a second plate. Each of the first and second plates has a first side, a second side, a back edge and a front edge. A biasing member is attached to each of the back edges of the plates and biases the first side of the first plate against the second side of the second plate. A tether is attached to the clamp. The tether is removably couplable to a bed on which the sheet is positioned. An opening apparatus is removably engaged with the clamp and is actuated to open the clamp.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

The objects of the invention, along with the various features of novelty which characterize the invention, are pointed out with particularity in the claims annexed to and forming a part of this disclosure.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
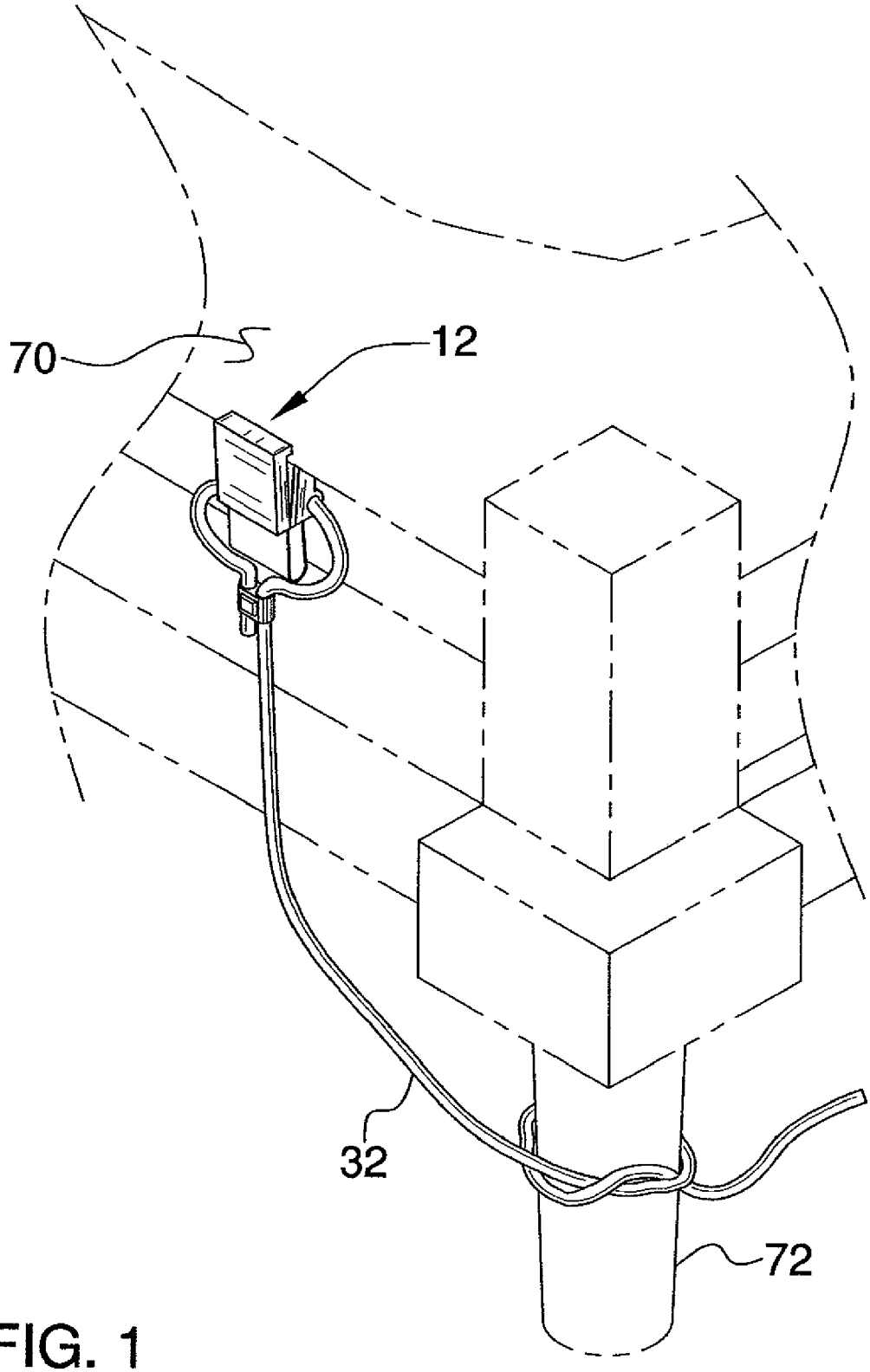
FIG. 1 is a perspective in-use view of a bed sheet securing assembly according to the present invention.
Figure 2:
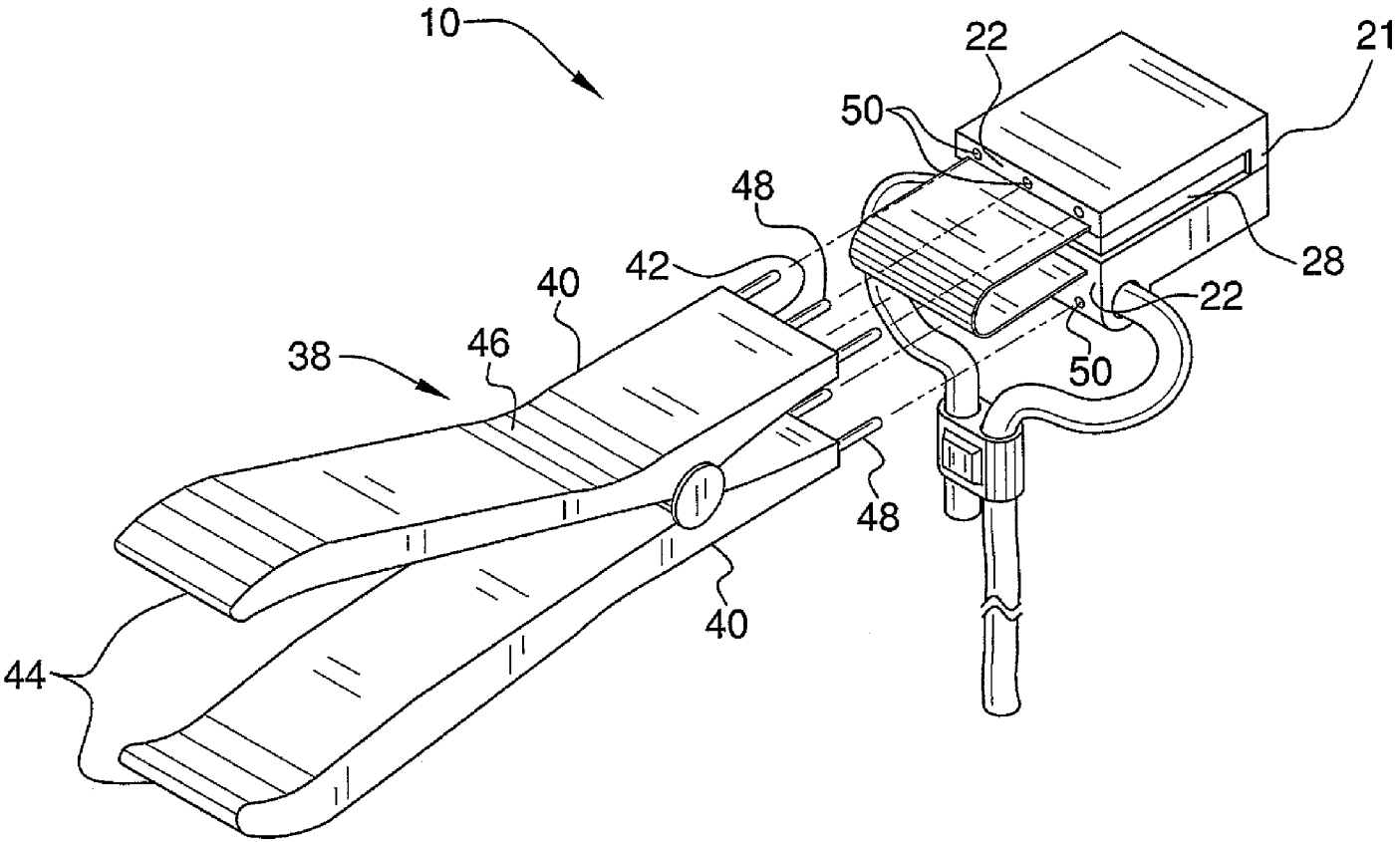
FIG. 2 is a rear perspective view of the present invention.
Figure 3:
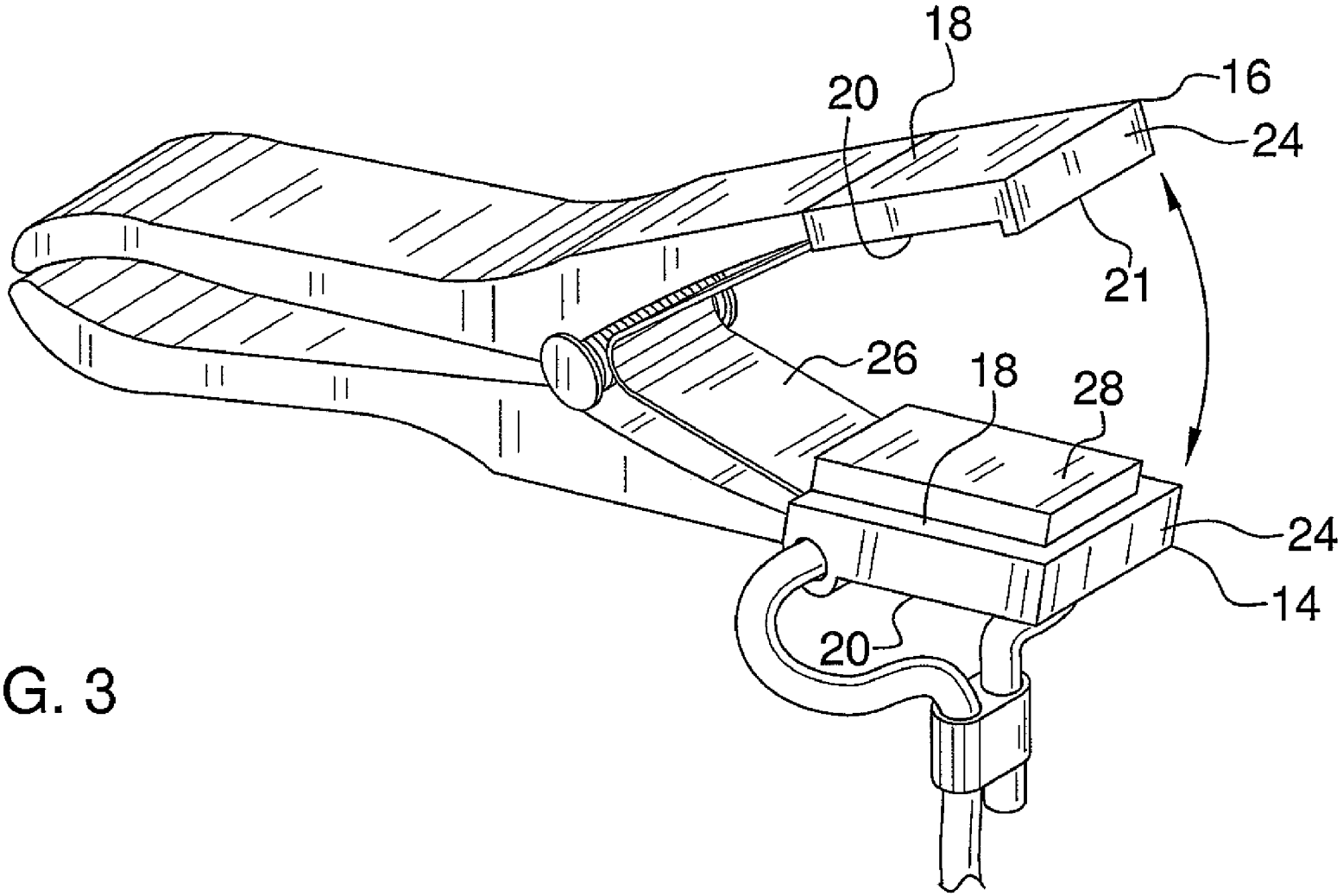
FIG. 3 is a front perspective view of the present invention.

With reference now to the drawings, and in particular to FIGS. 1 through 5 thereof, a new bed sheet securing device embodying the principles and concepts of the present invention and generally designated by the reference numeral 10 will be described.

As best illustrated in FIGS. 1 through 5, the bed sheet securing assembly 10 generally comprises a clamp 12 that is removably attachable to a bed sheet 70. The clamp 12 includes a first plate 14 and a second plate 16. Each of the first 14 and second 16 plates has a first side 18, a second side 20, a back edge 22 and a front edge 24. A biasing member 26 is attached to each of the back edges 22 of the plates 14, 16 and biases the first side 18 of the first plate 14 against the second side 20 of the second plate 16. The biasing member 26 may comprise a metallic band or a spring. The first side 18 of the first plate 14 includes a raised section 28. The second side 20 of the second plate 16 has a lip 21 extending downwardly therefrom to engage the raised section 28.

Figure 5:
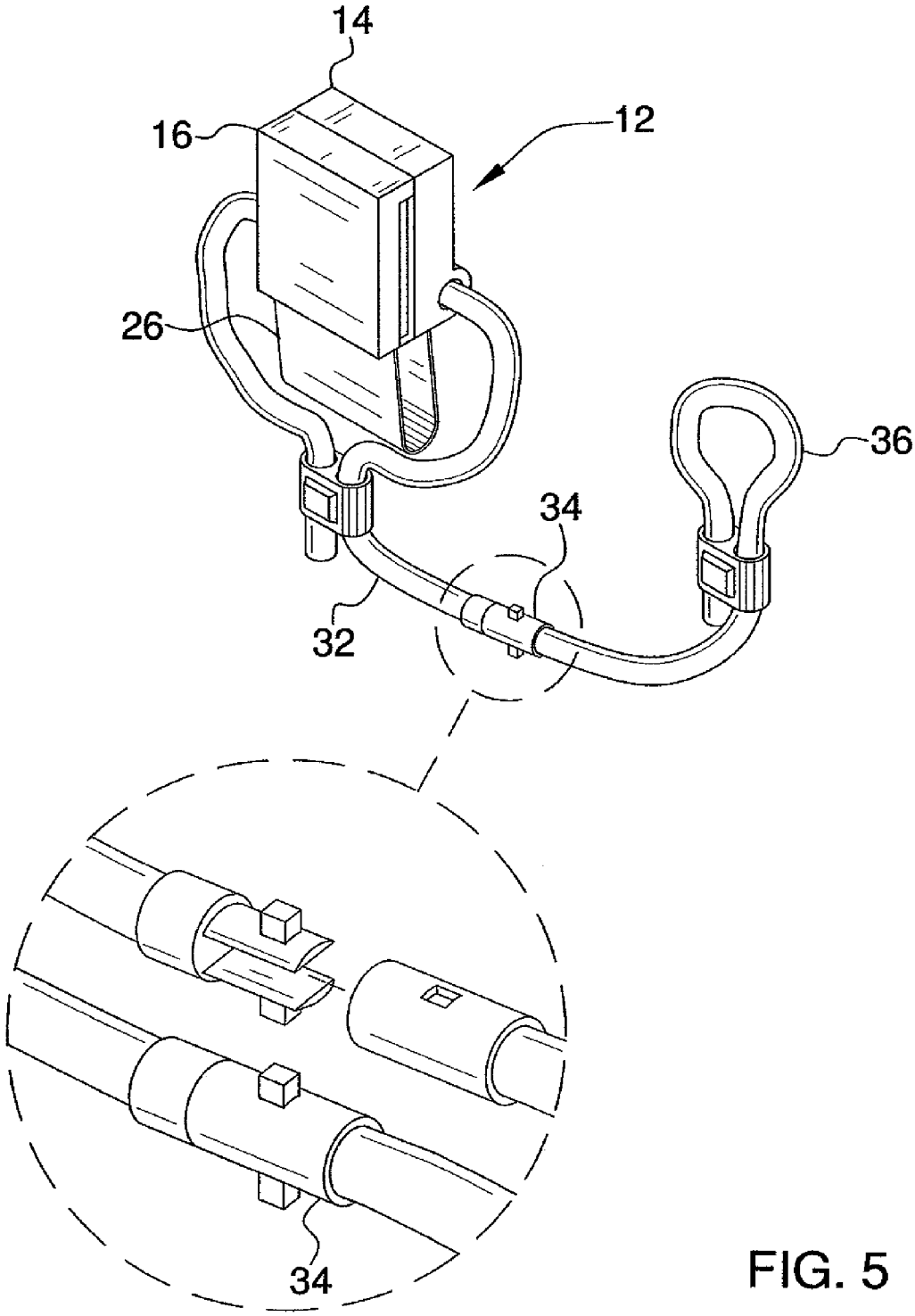
FIG. 5 is a perspective view of a second embodiment of a tether of the present invention.

A tether 32 is attached to the clamp 12. The tether 32 has a selectively adjustable length. The tether 32 is removably couplable to a portion of a bed frame 72, such as its leg. As shown in FIG. 5, the tether 32 may include a pair of sections which are removably connectable with a connector 34. This would allow sections having different features to be attached together, such as a section including a loop 36.

An opening apparatus 38 is removably engaged with the clamp 12 and is actuated to open the clamp 12. The opening apparatus 38 includes a pair of arms 40 having a first end 42 and a second end 44. The arms 40 are pivotally coupled together between associated ones of the first 42 and second 44 ends. Each of the arms 40 has a bend 46 therein and the second ends 44 are spaced from each other and urge the first ends 42 away from each other when the second ends 44 are moved toward each other. Each of the first ends 42 has at least one rod 48 attached thereto. The at least one rod 48 is extendable into corresponding apertures 50 in the back edges 26 of the first 14 and second 16 plates to releasably couple each of the arms 40 to one of the first 14 and second 16 plates. The first 14 and second 16 plates are moved away from each other when the second ends 44 of the arms 40 are moved toward each other.

Figure 4:
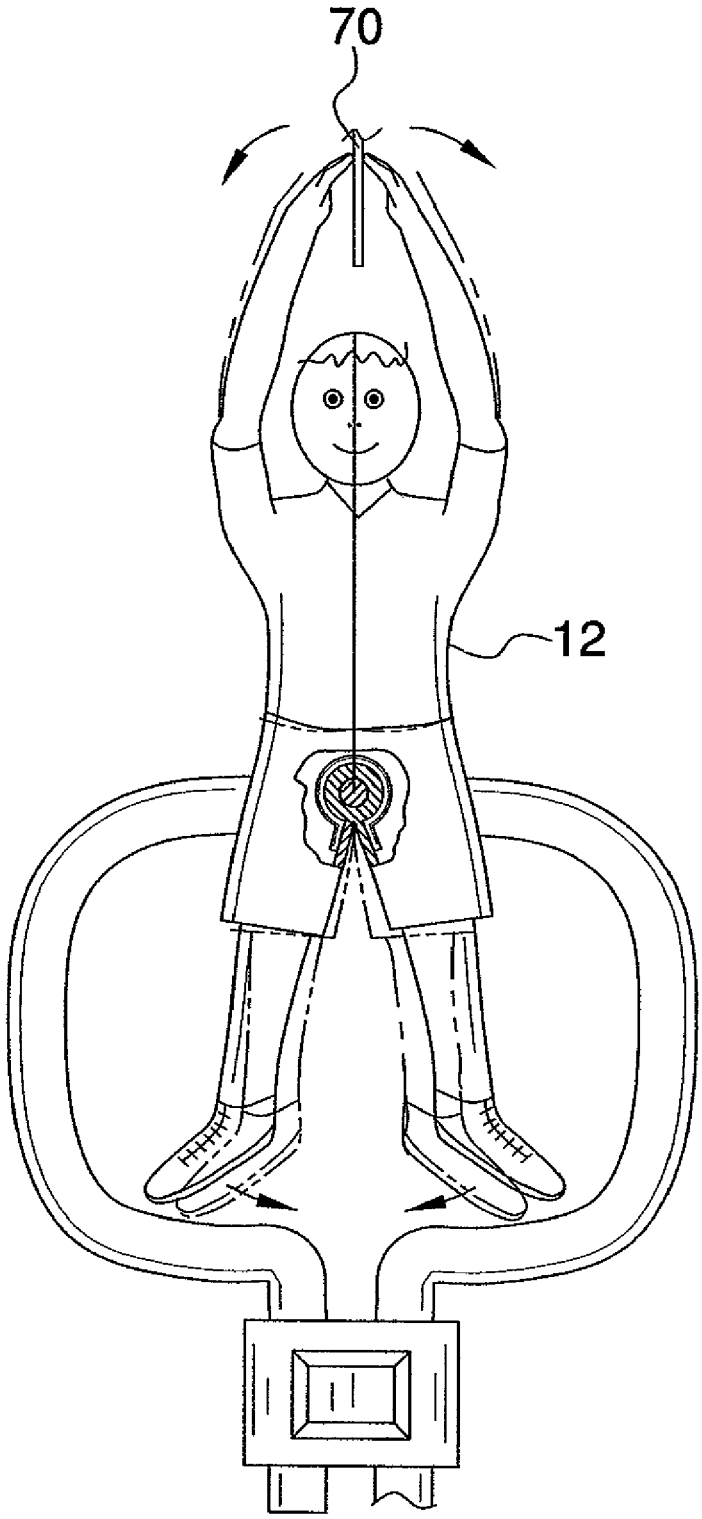
FIG. 4 is a front view of a second embodiment of a clamp of the present invention.

A second embodiment of the clamp 12 is shown in FIG. 4 and comprises a clamp 12 having a cartoon type shape. The clamp 12 may have any number of shapes to entertain a child or to accentuate a bed. The clamp 12 of the second embodiment does not include an opening apparatus 38 and the arms 40 are integrally coupled to the clamp 12.

In use, the clamp 12 is opened with the opening apparatus 38 and positioned on the sheet 70. The tether 32 is then secured to a portion of the bed 72. The tether 32 and clamp 12 prevent the pulling of the sheet 70 off of the bed 72 and a plurality of assemblies 10 may be used at one time. The raised portion 28 and the depression 30 form interlocking portions better secure the sheet 70 between the first 14 and second 16 plates. Because the opening apparatus 38 is needed to open the clamp 12, a child will not be able to easily remove the clamp 12 from the sheet 70 and the clamp 12 will be more easily hidden under blankets because of its smaller profile.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A bed sheet securing assembly, said assembly releasably coupling a bed sheet to a bed frame, said assembly comprising:

a clamp being removably attachable to the bed sheet, said clamp including a first plate and a second plate, each of said first and second plates having a first side, a second side, a back edge and a front edge, a biasing member being attached to each of said back edges of said plates and biasing said first side of said first plate against said second side of said second plate, said biasing member extending away from said back edges and rearward of said first and second plates;

a tether being attached to said clamp, said tether being removably couplable to the bed frame by tying said tether to the bed frame;

an opening apparatus being removably engaged with said clamp and being actuated to open said clamp, said opening apparatus engaging said back edges to extend said biasing member into said opening apparatus; and said opening apparatus includes a pair of arms having a first end and a second end, said arms being pivotally coupled together between associated ones of said first and second ends, each of said arms having a bend therein and said second ends being spaced from each other and urging said first ends away from each other when said second ends are moved toward each other, each of said first ends having at least one rod attached thereto, said at least one rod being extendable into corresponding apertures in said back edges of said first and second plates to releasably couple each of said arms to one of said first and second plates, said first and second plates being moved away from each other when said second ends of said arms are moved toward each other.

2. The assembly according to claim 1, wherein said first side of said first plate includes a raised section and said second side of said second plate has a lip thereon to engage said raised section.

3. The assembly according to claim 1, wherein said tether has a selectively adjustable length.

4. A bed sheet securing assembly, said assembly releasably coupling a bed sheet to a bed frame, said assembly comprising:

a clamp being removably attachable to the bed sheet, said clamp including a first plate and a second plate, each of said first and second plates having a first side, a second side, a back edge and a front edge, a biasing member being attached to each of said back edges of said plates and biasing said first side of said first plate against said second side of said second plate, said first side of said first plate including a raised section, said second side of said second plate having a lip thereon to engage said raised section, said biasing member extending away from said back edges and rearward of said first and second plates;

a tether being attached to said clamp, said tether having a selectively adjustable length, said tether being removably couplable to the bed frame by tying said tether to the bed frame; and an opening apparatus being removably engaged with said clamp and being actuated to open said clamp, said opening apparatus including a pair of arms having a first end and a second end, said arms being pivotally coupled together between associated ones of said first and second ends, each of said arms having a bend therein and said second ends being spaced from each other and urging said first ends away from each other when said second ends are moved toward each other, each of said first ends having at least one rod attached thereto, said at least one rod being extendable into corresponding apertures in said back edges of said first and second plates to releasably couple each of said arms to one of said first and second plates, said first and second plates being moved away from each other when said second ends of said arms are moved toward each other, said biasing member being positioned between said arms when said opening apparatus engages said clamp.

* * * * *